US011002219B1

(12) United States Patent
Cress

(10) Patent No.: US 11,002,219 B1
(45) Date of Patent: May 11, 2021

(54) SPARK PLUG GASKET CRUSH LIMITER

(71) Applicant: Caterpillar Inc., Peoria, IL (US)

(72) Inventor: James Jay Cress, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/865,532

(22) Filed: May 4, 2020

(51) Int. Cl.

| | |
|---|---|
| ***H01T 13/08*** | (2006.01) |
| ***F02F 1/24*** | (2006.01) |
| ***H01T 13/10*** | (2006.01) |
| ***H01T 13/20*** | (2006.01) |
| ***F02F 11/00*** | (2006.01) |

(52) U.S. Cl.
CPC ..... *F02F 1/242* (2013.01); *F02F 11/002* (2013.01); *H01T 13/08* (2013.01); *H01T 13/10* (2013.01); *H01T 13/20* (2013.01)

(58) Field of Classification Search
CPC ..... F02F 1/242; F02F 11/002; H01T 13/20; H01T 13/10; H01T 13/02; H01T 13/06; H01T 13/08
See application file for complete search history.

(56) References Cited

U.S. PATENT DOCUMENTS

| | | | | |
|---|---|---|---|---|
| 4,015,161 | A | 3/1977 | Resler, Jr. | |
| 9,787,063 | B2 | 10/2017 | Niessner et al. | |
| 2009/0102346 | A1* | 4/2009 | Fukuzawa | H01T 13/08 313/135 |

FOREIGN PATENT DOCUMENTS

| | | | |
|---|---|---|---|
| FR | 2642497 | A1 | 8/1990 |

* cited by examiner

*Primary Examiner* — Jacob M Amick
(74) *Attorney, Agent, or Firm* — Law Office of Kurt J. Fugman LLC

(57) ABSTRACT

A spark plug includes a body of revolution defining a longitudinal axis. The body has a forward axial portion with external threads, and an intermediate axial collar portion defining an axially downwardly facing sealing surface. A first electrode and a second electrode extend from the forward axial portion and define a spark gap therebetween. A hex drive portion is disposed axially above the intermediate collar portion. A gasket crush limiter includes a wall that extends axially downwardly from the intermediate axial collar portion, defining an annular pocket formed by the wall and the forward axial portion.

20 Claims, 4 Drawing Sheets

SPARK PLUG GASKET CRUSH LIMITER

TECHNICAL FIELD

The present disclosure relates generally to spark plugs and gaskets/seals that are used in internal combustion engines to prevent gases from blowing out of the combustion chamber through a gap located between the spark plug and the cylinder head of the engine. More specifically, the present disclosure relates to a spark plug having a feature that limits the amount of compression exerted on the gasket/seal.

BACKGROUND

Internal combustion engines are routinely used in various industries to power machines and equipment. Examples of industries using such machines and equipment include marine, earth moving, construction, mining, locomotive and agriculture industries, etc. Some of these engines employ spark plugs that have gaskets or seals interposed between the spark plug and the spark plug bore in the cylinder head. These seals or gaskets help to prevent gases that are highly pressured from escaping the combustion chamber through the spark plug bore (sometimes referred to as "blow by"). From time to time, these spark plugs are unscrewed from the cylinder head for maintenance purposes. Then, a new or refurbished spark plug is provided by screwing the spark plug so that its external threads mate with the internal threads of the spark plug bore.

More specifically, a mechanic or the like may use a wrench or a socket to engage the hex portion of the spark plug to tighten it properly. However, over torqueing the spark plug can lead to the spark plug pressing on the seal/gasket via its seal engaging surface too much. In technical parlance, this may be referred to as "crushing" the seal and gasket. If the deformation is permanent (plastic), this may remove the requisite elasticity from the gasket/seal that is necessary to prevent the "blow by". This may lead to poor performance and thus undesirable additional maintenance.

U.S. Pat. No. 9,787,063 to Niessner discloses a sealing ring for a spark plug that has an external thread for screwing into an internal combustion engine, a collar, and thread undercut between the external thread and the collar. The sealing ring include a ring-shaped solid sealing element made from metal. The sealing element has two planar annular sealing surfaces that are arranged parallel to one another. An annular retaining element composed of an elastomer for engaging in the thread undercut of the spark plug in a self-retaining manner is attached to the sealing element on the inner ring side thereof. Also, there is a spark plug comprising such a sealing ring, and an internal combustion engine comprising such spark plugs.

SUMMARY OF THE DISCLOSURE

An internal combustion engine according to an embodiment of the present disclosure may comprise a cylinder head that includes a flame deck surface that at least partially defines a combustion chamber, a spark plug receiving bore that defines a longitudinal axis, a radial direction, and a circumferential direction, and that includes an enlarged diameter portion including an axially upwardly facing sealing surface, and a reduced diameter portion including internal threads. The engine may further comprise a spark plug including a forward axial portion including external threads meshing with internal threads of the reduced diameter portion of the spark plug receiving bore, and an intermediate axial collar portion defining an axially downwardly facing sealing surface. A gasket may be disposed axially between the axially upwardly facing sealing surface of the spark plug receiving bore, and the axially downwardly facing sealing surface of the spark plug. The spark plug may further comprise a gasket crush limiter including a wall that extends radially outwardly and axially downwardly from the intermediate axial collar portion toward the axially upwardly facing sealing surface of the spark plug receiving bore, radially surrounding the gasket.

A spark plug assembly according to an embodiment of the present disclosure may comprise a spark plug including a body of revolution defining a longitudinal axis, a radial direction, and a circumferential direction. The spark plug may further include a forward axial portion including external threads, an intermediate axial collar portion defining an axially downwardly facing sealing surface, and a first electrode and a second electrode extending from the forward axial portion, defining a spark gap therebetween. A gasket may be disposed axially between the axially downwardly facing sealing surface, and the external threads of the forward axial portion. The spark plug further comprises a gasket crush limiter including a wall that extends radially outwardly and axially downwardly from the intermediate axial collar portion, defining an annular pocket with a radially outer pocket wall that at least partially surrounds the gasket radially.

A spark plug according to an embodiment of the present disclosure may comprise a body of revolution defining a longitudinal axis, a radial direction, and a circumferential direction. The spark plug may further include a forward axial portion including external threads, an intermediate axial collar portion defining an axially downwardly facing sealing surface, and a first electrode and a second electrode extending from the forward axial portion and defining a spark gap therebetween. A hex drive portion may be disposed axially above the intermediate collar portion. The spark plug further comprises a gasket crush limiter including a wall that extends axially downwardly from the intermediate axial collar portion, defining an annular pocket formed by the wall and forward axial portion.

DETAILED DESCRIPTION

Figure 1:
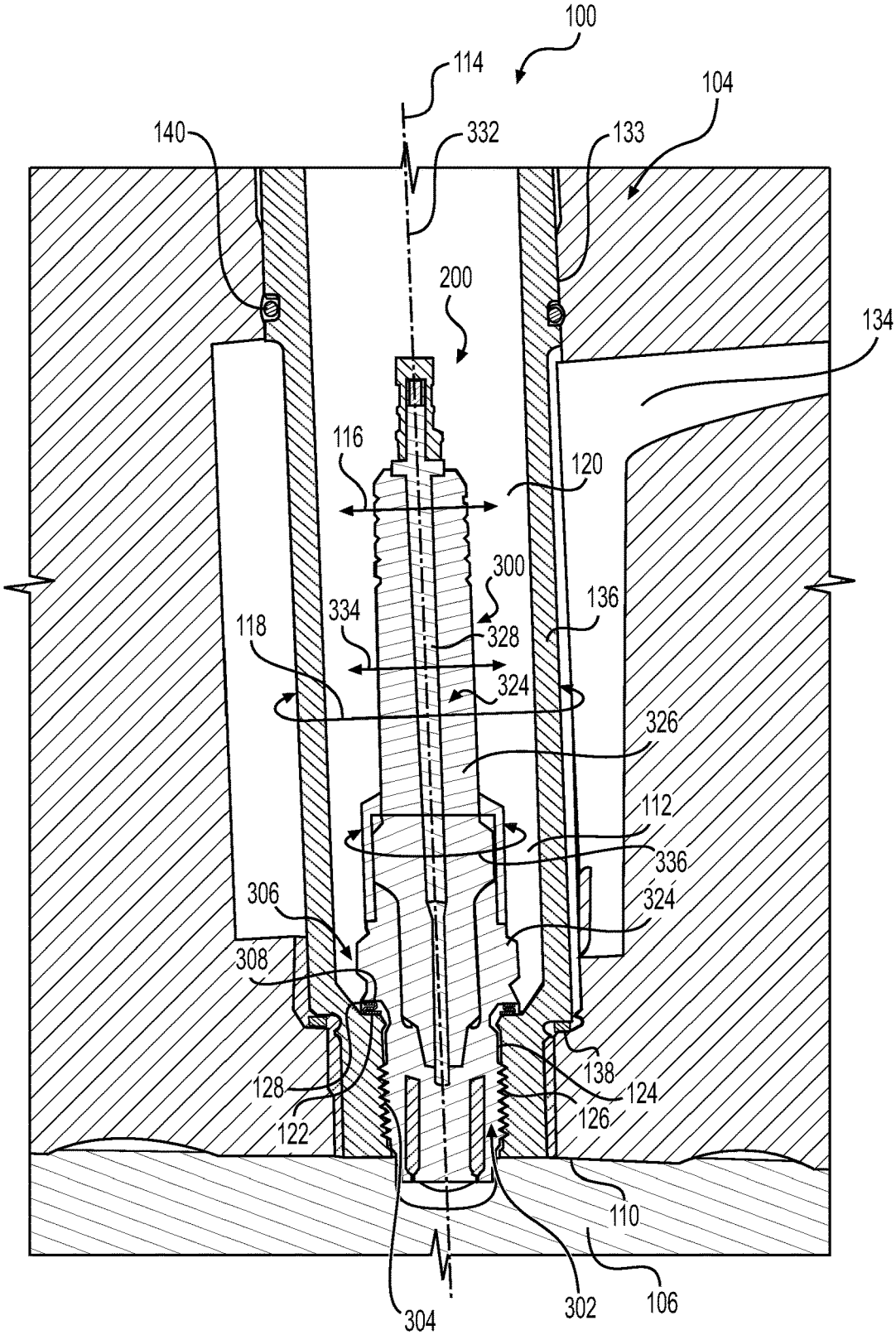
FIG. 1 is a sectional side view of an internal combustion engine that employs spark plugs and spark plug assemblies having gaskets/seals according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100"etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

Various embodiments of a spark plug or a spark plug assembly that may be used in an internal combustion engine according to various embodiments of the present disclosure will now be described. More particularly, the spark plug or spark plug assembly may include a gasket crushing limiter that will be described in detail.

For example, an internal combustion engine 100 is shown in FIG. 1 that may employ various embodiments of the spark plug or spark plug assembly constructed according to the principles set forth herein. The engine 100 may include an engine block (not clearly shown) in which the piston (not shown) reciprocates, and a cylinder head 104 that may contain various engine components for the introduction of fluids into the bore/combustion chamber 106 located in the engine block as well as the spark plug assembly 200 and/or spark plug 300. It is to be understood that the spark plug itself is often a subassembly composed of a number of parts, but not necessarily so.

More specifically, the engine 100 includes a cylinder head 104 having a flame deck surface 110 that at least partially defines a combustion chamber 106. The spark plug assembly 200 or spark plug 300 extends past this surface 110 into the combustion chamber 106 to ignite the fuel/air mixture during operation of the engine 100.

The cylinder head 104 has a spark plug receiving bore 112 that defines a longitudinal axis 114, a radial direction 116, and a circumferential direction 118. For example, this bore 112 may have a cylindrical or conical shape, etc. Consequently, this bore 112 includes an enlarged diameter portion 120 including an axially upwardly facing sealing surface 122, and a reduced diameter portion 124 including internal threads 126. Portion 124 is disposed axially below portion 120, but not necessarily so.

A spark plug 300 may be disposed in the spark plug receiving bore 112. This spark plug 300 may include a forward axial portion 302 including external threads 304 that mesh with internal threads 126 of the reduced diameter portion 124 of the spark plug receiving bore 112 (see also FIG. 2), and an intermediate axial collar portion 306 defining an axially downwardly facing sealing surface 308 in opposing relationship with the axially upwardly facing sealing surface 122.

Figure 2:
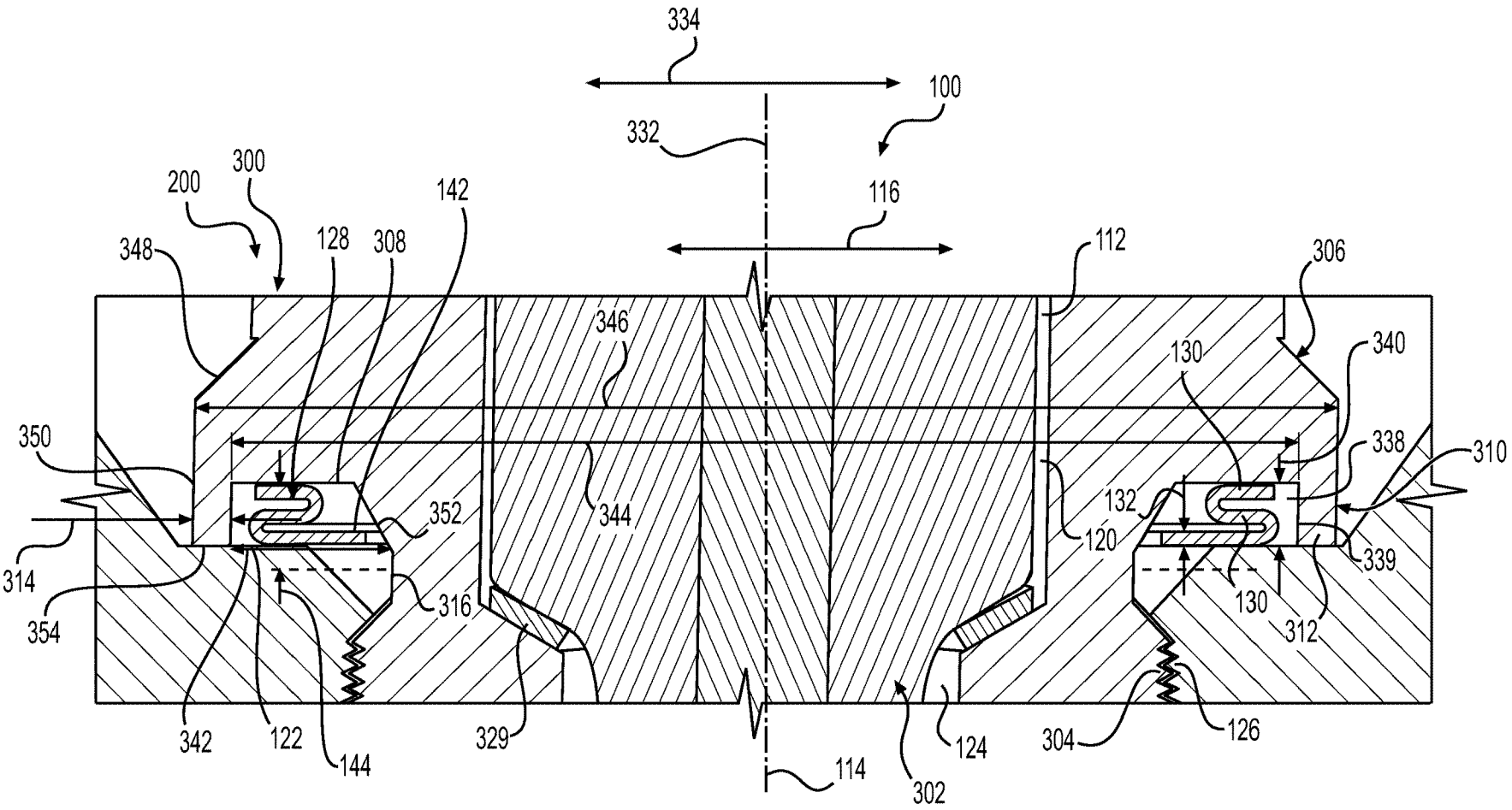
FIG. 2 is an enlarged sectioned side view of the internal combustion engine of FIG. 1, showing more clearly a gasket/seal and a gasket crush limiter of the spark plug assembly according to an embodiment of the present disclosure.

As seen in FIGS. 1 and 2, a gasket 128 may be disposed axially between the axially upwardly facing sealing surface 122 of the spark plug receiving bore 112, and the axially downwardly facing sealing surface 308 of the spark plug 300. The gasket may take any suitable shape including an O-ring shape, a quad ring shape, U-shaped, etc.

As best seen in FIG. 2, the spark plug 300 further comprises a gasket crush limiter 310 including a wall 312 that extends radially outwardly and axially downwardly from the intermediate axial collar portion 306 toward the axially upwardly facing sealing surface 122 of the spark plug receiving bore 112. This wall 312 may partially or completely radially surround the gasket 128.

Once the spark plug 300 is fully installed, the wall 312 of the gasket crush limiter 310 may contact the axially upwardly facing sealing surface 122 of the spark plug receiving bore 112. The wall 312 and the gasket 128 may be so configured such that the gasket cannot be compressed too much. In particular embodiments of the present disclosure, the gasket 128 includes a serpentine shape (i.e. having at least one bend) including straight portions 130 that are spaced at least partially axially away (i.e. parallel to the axis 114) from each other. Put another way in spring terminology, the gasket is not compressed completely to its solid length or solid state.

The gasket may be manufactured from various types of materials including elastomers, rubbers, metal, aluminum, stainless steel, etc. As shown in FIG. 2, the gasket 128 is made from metal that is bent into the serpentine shape, and that defines a gasket minimum wall thickness 132, and the wall 312 of the gasket crush limiter 310 defines a radial wall thickness 314 that is greater than the gasket minimum wall thickness 132.

As mentioned previously herein, the spark plug 300 may be a subassembly. Accordingly, the wall of the gasket crush limiter 310 could be a separate component that is attached to the spark plug. On the other hand, the wall 312 of the gasket crush limiter 310 may be unitary (i.e. constructed from a single piece) with the intermediate axial collar portion 306 of the spark plug as shown in FIG. 2.

Likewise as seen in FIG. 1, the cylinder head 104 may also be formed as a subassembly. For example, the cylinder head 104 may define a spark plug sleeve receiving bore 133, a cooling chamber 134 that is in communication with the spark plug sleeve receiving bore 133, and a spark plug sleeve 136 that is disposed in the spark plug sleeve receiving bore 133. As a result of this arrangement, the spark plug sleeve 136 is at least partially surrounded by the cooling chamber 134, and the spark plug receiving bore 112 is defined by the spark plug sleeve 136. Hence, the spark plug is separated and/or insulated from the cooling chamber 134 and any cooling fluid that is in this chamber. The spark plug sleeve 136 has an at least partially annular shape (e.g. cylindrical, conical, etc.) about the longitudinal axis 114, forming the spark plug receiving bore 112 for receiving the spark plug 300.

It is desirable to separate the cooling fluid from the combustion chamber 106 and its gases, and the spark plug sleeve receiving bore 133, and vice versa. So, a lower axial seal 138 may be disposed between the spark plug sleeve 136, and the cylinder head 104, and while an upper axial seal 140 may be disposed between the spark plug sleeve 136, and the cylinder head 104.

In FIG. 2, the spark plug 300 may define an external thread undercut 316 (in the radial direction) that is disposed axially between the external threads 304 of the forward axial portion 302, and the axially downwardly facing sealing surface 308 of the intermediate axial collar portion 306. The gasket 128 may include a leg 142 that extends radially into the external thread undercut 316 to form the assembly 200. That is to say, the gasket will naturally be retained on the spark plug during installation and removal since it cannot fall axially off the spark plug without intentional prying or unscrewing past the threads 304, etc.

Figure 3:
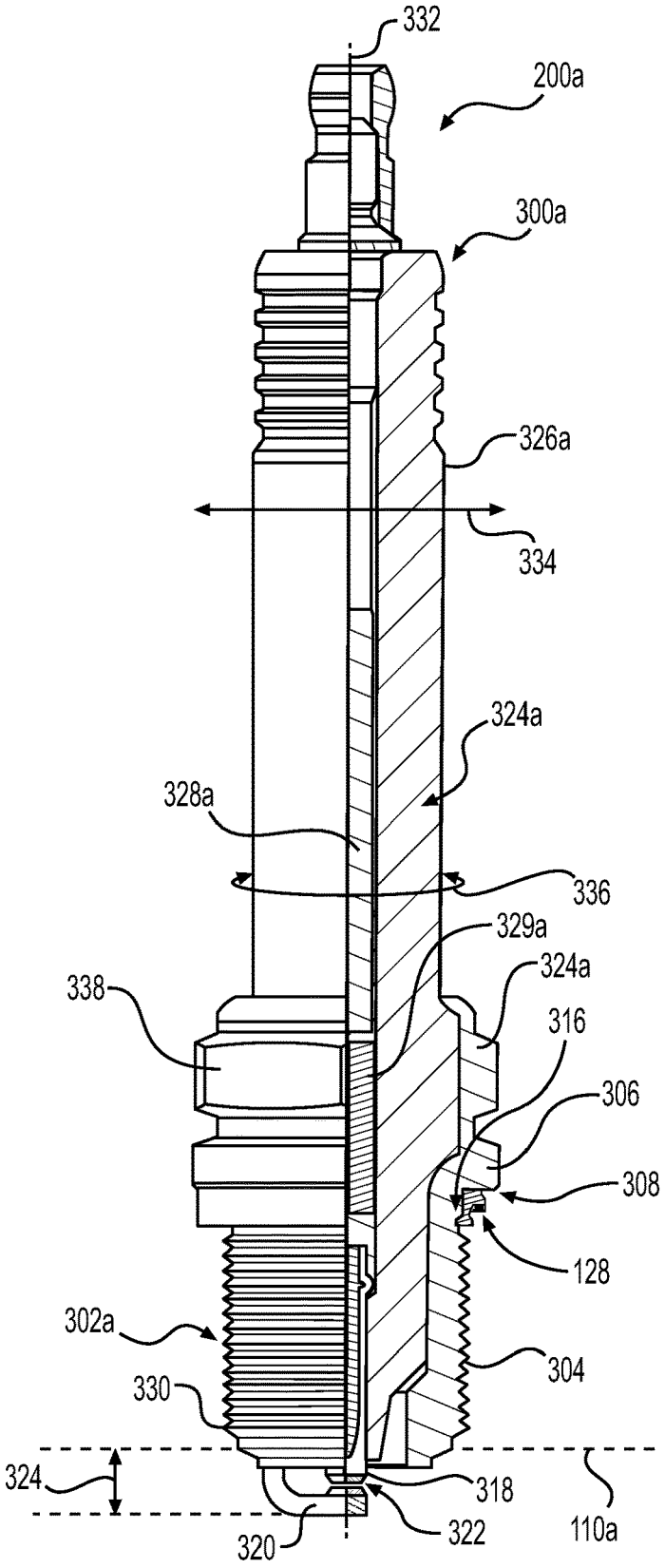
FIG. 3 is a partial sectioned side view of a spark plug assembly similar to that of FIGS. 1 and 2 removed from the engine for enhanced clarity.

Looking at FIG. 3, the spark plug **300*a* may further comprise two electrodes (e.g. a center electrode 318, and a ground electrode 320) that extend from the forward axial portion 302 and that define a spark gap 322 between them. In some of the embodiments of the present disclosure, at least one of the two electrodes (e.g. ground electrode 320**)

defines an axial extremity 324 of the spark plug 300*a* that is spaced axially away from the flame deck surface 110*a* a predetermined axial distance 324 when the wall 312 of the gasket crush limiter 310 contacts the axially upwardly facing sealing surface 122 of the cylinder head 104 (as seen in FIG. 2).

In addition, at least one of the two electrodes (e.g. ground electrode 320) in FIG. 3 may extend at least partially radially from a point that is proximate to the external threads 304, and the circumferential orientation of the at least one electrode may be predetermined when the wall 312 of the gasket crush limiter 310 contacts the axially upwardly facing sealing surface 122 of the cylinder head 104 (as seen in FIG. 2).

In other words, the relative configuration of the wall, the gasket, and timing of the engagement between the internal and the external threads may be selectively chosen so that a consistent position and orientation of the spark plug and its components as well as the gasket is achieved every time the spark plug is fully tightened. This may not be the case for other embodiments of the present disclosure.

Next, a spark plug assembly 200, 200*a* that may be provided as a replacement part/assembly according to various embodiments of the present disclosure will be described.

Turning to FIGS. 1 and 3, two examples of such a spark plug assembly 200, 200*a* may be seen. It is to be understood that the spark plug assembly 200 as shown in FIG. 1 may be similarly constructed to the spark plug assembly 200*a* of FIG. 3 with components having slightly different configurations, proportions, and/or materials.

The spark plug assembly 200, 200*a* may be constructed as follows. A gasket as previously described 128 may be retained onto a spark plug 300, 300*a* in a manner discussed earlier herein (e.g. captivated by a portion of the gasket extending into the external thread undercut). This may ease installation and help prevent damage to the gasket 128 during installation.

The spark plug 300, 300*a* may include a sleeve-shaped spark plug body 324, 324*a* made from metal and an elongated insulator 326, 326*a* made from ceramics. In a more general sense, the body 324, 324*a* may be characterized as a body of revolution since its geometry is at least partially created by rotating a geometrical cross-section about a longitudinal axis 332, further defining a radial direction 334 and a circumferential direction 336. The insulator 326, 326*a* may surround an inner conductor 328, 328*a* which is connected inside the insulator 326, 326*a* to the center electrode 318 via a glass seal 329*a* in FIG. 3 or an inside gasket 329 in FIG. 2.

Focusing on FIG. 3, the ground electrode 320, which forms a spark gap 322 with the center electrode 318, is attached to the spark plug body 324*a*. The electrodes 318, 320 are arranged at the forward axial portion 302*a* of the spark plug 324 (and therefore the spark plug body 324*a*) that protrudes into the combustion chamber in the installed state. At the forward axial portion 302*a*, the spark plug body 324*a* has external threads 304 for screwing the spark plug into a corresponding internal thread of a spark plug bore in a cylinder head of the internal combustion engine.

The beginning of the first thread turn of the threads is designated as thread start 330, and may have a defined circumferential position/orientation with respect to the ground electrode 320. After screwing into the internal combustion engine, the section of the ground electrode 320 (referred to earlier as the radial extending portion) that runs transverse to the longitudinal axis 332 of the spark plug 300*a* may then have a predefined angle with respect to the crankshaft (not shown). This may not be the case for other embodiments of the present disclosure.

The spark plug body 324*a* may also have an intermediate axial collar portion 306, which is arranged on the side of the external threads 304 that faces away from the forward axial portion 302*a*. A hex drive portion 338 may also be provided that is disposed axially above the intermediate axial collar portion 306.

As alluded to earlier herein with reference to FIG. 2, the spark plug 300, 300*a* may further comprise a gasket crush limiter 310 including a wall 312 that extends radially outwardly and axially downwardly from the intermediate axial collar portion 306, defining an annular pocket 338 with a radially outer pocket surface 339 that at least partially surrounds the gasket 128 radially.

The annular pocket 338 may define an axial depth 340, and a radial width 342 in a plane containing the longitudinal axis 332 and the radial direction 334 (e.g. the sectioned plane of FIG. 2 and FIG. 4) that is greater than the axial depth 340. The gasket 128 may define a gasket free height 144 measured along axis 322 that is greater than the axial depth 340, and a ratio of the difference of the gasket free height 144 minus the axial depth 340 divided by the gasket free height 144 may range from 20% to 50% in some embodiments. In certain embodiments, this range may be 25% to 35%. Other dimensional ranges and ratios are possible in other embodiments of the present disclosure.

In addition, the annular pocket 338 may define a pocket outer diameter 344, and the wall 312 of the gasket crush limiter 310 defines a wall outer diameter 346. In some embodiments, the gasket 128 defines a gasket minimum wall thickness 132 that is less than the radial wall thickness 314 of the wall 312 of the gasket crush limiter 310. Put another way, the radial wall thickness 314 may be greater than the gasket minimum wall thickness 132.

In some embodiments as best seen in FIG. 2, the gasket 128 may include an undulating strip (i.e. has at least one apex) of material that defines a minimum wall thickness 132, and the wall 312 of the gasket crush limiter 310 may define a radial wall thickness 314 that is at least 2.0 times greater than the minimum wall thickness 132. This may not be the case for other embodiments of the present disclosure.

Now, an embodiment of a spark plug 300, 300*a* that may be supplied as a replacement part/subassembly will now be discussed with continued reference to FIG. 2.

The gasket crush limiter 310 may include a wall 312 that extends axially downwardly from the intermediate axial collar portion 306, defining an annular pocket 338 formed by the wall 312 and forward axial portion 302. In such a case, the intermediate axial collar portion 306 may not be flared as shown in FIGS. 2 thru 4.

Figure 4:
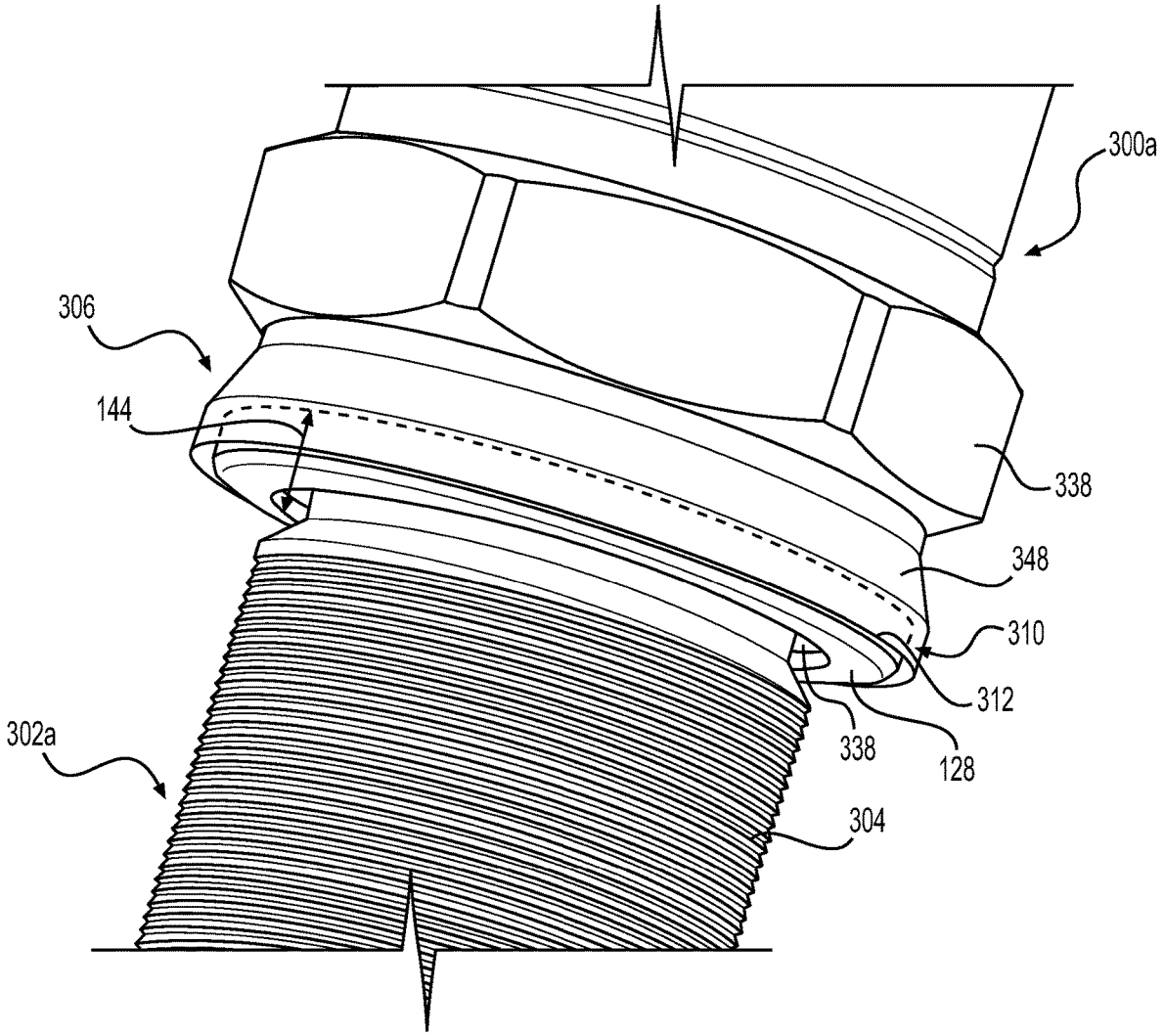
FIG. 4 is an enlarged perspective view of the spark plug of FIG. 2 showing the gasket extending freely from the pocket of the gasket crush limiter.

However, in some embodiments of the present disclosure as shown in FIGS. 2 thru 4, the intermediate axial collar portion 306 may be flared and include a transitional surface 348 (radius, ellipse, polynomial, conical, etc.) that extends axially downwardly and radially outwardly from the axial intermediate collar portion 306 to the wall 312. As shown, the transitional surface 348 may be conical.

Focusing on FIG. 2, the annular pocket 338 is defined by the axially downwardly facing sealing surface 308 that may be planar, an outer circumferential surface 350 that extends from the axially downwardly facing sealing surface 308 and that is cylindrical, and an inner circumferential surface 352 that extends from the axially downwardly facing sealing surface 308, and that is conical. Any of these surfaces 308, 350, and 352 may be differently configured in other embodiments of the present disclosure.

In certain embodiments, the wall 312 of the gasket crush limiter 310 terminates at a plane 354 that is perpendicular to the longitudinal axis 332, and the inner circumferential surface 352 may terminate at the same plane 354. This may not be the case for other embodiments of the present disclosure.

The configuration and dimensional ranges of any of the embodiments discussed herein may be altered to be different depending on the application.

The spark plug and gasket may be manufactured from any suitable material using any suitable manufacturing process including but not limited to anything specifically, implicitly, or inherently described herein.

INDUSTRIAL APPLICABILITY

In practice, a spark plug, a spark plug assembly, and/or an engine assembly using such a spark plug or spark plug assembly according to any embodiment described herein may be provided, sold, manufactured, and bought etc. as needed or desired in an aftermarket or OEM (original equipment manufacturer) context. For example, a spark plug or a spark plug assembly may be used to retrofit an existing engine already in the field or may be sold with an engine or a piece of equipment using that engine at the first point of sale of the piece of equipment.

Various embodiments may provide for reduced maintenance of the engine due to less damage to the spark plug gasket. Also, proper positioning and/or orientation of the electrodes of the spark plug may be more reliably provided.

Moreover, the disclosed dimensional ranges and/or ratio ranges may provide a critical result not taught in the prior art. Particularly, these variables may allow the wall of the gasket crush limiter take 90% or more of the axial load created when the spark plug is tightened, helping to protect the gasket from being over compressed or crushed. Also, the pocket that receives the gasket and the features defining and/or surrounding the pocket may help to keep the gasket away from the bottom sealing surface of the wall of the limiter so that the gasket does not get pinched, etc. during installation.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An internal combustion engine comprising:

a cylinder head that includes a flame deck surface that at least partially defines a combustion chamber;

a spark plug receiving bore that defines a longitudinal axis, a radial direction, and a circumferential direction, and that includes an enlarged diameter portion including an axially upwardly facing sealing surface, and a reduced diameter portion including internal threads;

a spark plug including a forward axial portion including external threads meshing with internal threads of the reduced diameter portion of the spark plug receiving bore, and an intermediate axial collar portion defining an axially downwardly facing sealing surface; and a gasket disposed axially between the axially upwardly facing sealing surface of the spark plug receiving bore, and the axially downwardly facing sealing surface of the spark plug;

wherein the spark plug further comprises a gasket crush limiter including a wall that extends radially outwardly and axially downwardly from the intermediate axial collar portion toward the axially upwardly facing sealing surface of the spark plug receiving bore, and that radially surrounds the gasket.

2. The internal combustion engine of claim 1 wherein the wall of the gasket crush limiter contacts the axially upwardly facing sealing surface, and the gasket includes a serpentine shape including straight portions spaced at least partially axially away from each other.

3. The internal combustion engine of claim 1 wherein the wall of the gasket crush limiter is unitary with the intermediate axial collar portion.

4. The internal combustion engine of claim 1 wherein the cylinder head defines a spark plug sleeve receiving bore, a cooling chamber that is in communication with the spark plug sleeve receiving bore, and a spark plug sleeve that is disposed in the spark plug sleeve receiving bore and that is at least partially surrounded by the cooling chamber.

5. The internal combustion engine of claim 4 wherein the spark plug receiving bore is defined by the spark plug sleeve, and the spark plug sleeve has an at least partially annular shape about the longitudinal axis.

6. The internal combustion engine of claim 5 further comprising a lower axial seal disposed between the spark plug sleeve and the cylinder head, and an upper axial seal disposed between the spark plug sleeve and the cylinder head.

7. The internal combustion engine of claim 2 wherein the spark plug defines an external thread undercut disposed axially between the external threads of the forward axial portion, and the axially downwardly facing sealing surface of the intermediate axial collar portion, and the gasket includes a leg that extends radially into the external thread undercut.

8. The internal combustion engine of claim 1 wherein the gasket defines a gasket minimum thickness, and the wall of the gasket crush limiter defines a radial wall thickness that is greater than the gasket minimum thickness.

9. The internal combustion engine of claim 1 wherein the spark plug further comprises two electrodes extending from the forward axial portion and that define a spark gap therebetween, and at least one of the two electrodes defines an axial extremity of the spark plug that is spaced axially away from the flame deck surface a predetermined axial distance when the wall of the gasket crush limiter contacts the axially upwardly facing sealing surface.

10. The internal combustion engine of claim 1 wherein at least one of the two electrodes extends at least partially radially from a point proximate to the external threads, and the circumferential orientation of the at least one electrode is predetermined when the wall of the crush limiter contacts the axially upwardly facing sealing surface.

11. A spark plug assembly comprising:

a spark plug including a body of revolution defining a longitudinal axis, a radial direction, and a circumferential direction, and further including a forward axial portion including external threads, an intermediate axial collar portion defining an axially downwardly facing sealing surface, and a first electrode and a second electrode extending from the forward axial portion and defining a spark gap therebetween; and a gasket disposed axially between the axially downwardly facing sealing surface, and the external threads of the forward axial portion;

wherein the spark plug further comprises a gasket crush limiter including a wall that extends radially outwardly and axially downwardly from the intermediate axial collar portion, defining an annular pocket with a radially outer pocket surface that at least partially surrounds the gasket radially.

12. The spark plug assembly of claim 11 wherein the annular pocket defines an axial depth, and a radial width in a plane containing the longitudinal axis and the radial direction that is greater than the axial depth.

13. The spark plug assembly of claim 12 wherein the gasket defines a gasket free height measured along the longitudinal axis that is greater than the axial depth, and a ratio of the difference of the gasket free height minus the axial depth divided by the gasket free height ranges from 20% to 50%.

14. The spark plug assembly of claim 11 wherein the ratio ranges from 25% to 35%.

15. The spark plug assembly of claim 11 wherein the gasket defines a gasket minimum wall thickness, and the wall of the gasket crush limiter defines a radial wall thickness that is greater than the gasket minimum wall thickness.

16. A spark plug comprising:

a body of revolution defining a longitudinal axis, a radial direction, and a circumferential direction, and further including a forward axial portion including external threads, an intermediate axial collar portion defining an axially downwardly facing sealing surface, and a first electrode and a second electrode extending from the forward axial portion and defining a spark gap therebetween; and a hex drive portion disposed axially above the intermediate axial collar portion;

wherein the spark plug further comprises a gasket crush limiter including a wall that extends axially downwardly from the intermediate axial collar portion, defining an annular pocket formed by the wall and the forward axial portion.

17. The spark plug of claim 16 further comprising a transitional surface that extends axially downwardly and radially outwardly from the axial intermediate collar portion to the wall.

18. The spark plug of claim 17 wherein the transitional surface is conical.

19. The spark plug of claim 18 wherein the annular pocket is defined by the axially downwardly facing sealing surface that is planar, an outer circumferential surface that extends from the axially downwardly facing seal surface and that is cylindrical, and an inner circumferential surface that extends from the axially downwardly facing seal surface and that is conical.

20. The spark plug of claim 19 wherein the wall of the gasket crush limiter terminates at a plane that is perpendicular to the longitudinal axis, and the inner circumferential surface terminates at the same plane that is perpendicular to the longitudinal axis.

* * * * *